US008138997B2

(12) United States Patent
Kim

(10) Patent No.: US 8,138,997 B2
(45) Date of Patent: Mar. 20, 2012

(54) PIXEL, ORGANIC LIGHT EMITTING DISPLAY USING THE SAME, AND ASSOCIATED METHODS

(75) Inventor: Yang-wan Kim, Suwon-si (KR)

(73) Assignee: Samsung Mobile Display Co., Ltd., Suwon-si, Gyeonggi-do (KR)

( * ) Notice: Subject to any disclaimer, the term of this patent is extended or adjusted under 35 U.S.C. 154(b) by 989 days.

(21) Appl. No.: 12/081,055

(22) Filed: Apr. 10, 2008

(65) Prior Publication Data

US 2008/0252217 A1 Oct. 16, 2008

(30) Foreign Application Priority Data

Apr. 10, 2007 (KR) ..... 10-2007-0035008

(51) Int. Cl.
*G09G 3/00* (2006.01)

(52) U.S. Cl. ..... 345/76; 315/51

(58) Field of Classification Search ..... 315/51, 315/169.3; 345/76, 204, 78, 82, 90
See application file for complete search history.

(56) References Cited

U.S. PATENT DOCUMENTS

| | | | | |
|---|---|---|---|---|
| 6,937,215 | B2 * | 8/2005 | Lo | 345/82 |
| 7,310,078 | B2 | 12/2007 | Kim | |
| 7,339,562 | B2 | 3/2008 | Ikeda | |
| 7,557,783 | B2 * | 7/2009 | Kim | 345/82 |
| 2003/0052614 | A1 | 3/2003 | Howard | |
| 2004/0145547 | A1 * | 7/2004 | Oh | 345/76 |
| 2005/0174311 | A1 | 8/2005 | Huh et al. | |
| 2005/0269958 | A1 | 12/2005 | Choi et al. | |
| 2006/0007072 | A1 | 1/2006 | Choi et al. | |
| 2006/0125807 | A1 * | 6/2006 | Park et al. | 345/204 |
| 2006/0132054 | A1 | 6/2006 | Kim et al. | |
| 2006/0139259 | A1 * | 6/2006 | Choi et al. | 345/76 |
| 2006/0139266 | A1 | 6/2006 | Choi | |
| 2007/0040772 | A1 | 2/2007 | Kim | |

FOREIGN PATENT DOCUMENTS

| | | |
|---|---|---|
| CN | 1 811 884 A | 8/2006 |
| EP | 1 496 495 A | 1/2005 |
| EP | 1 755 104 A | 2/2007 |

(Continued)

OTHER PUBLICATIONS

Choi, S.M., et al. "A Self-compensated Voltage Programming Pixel Structure for Active-Matrix Organic Light Emitting Diodes", IDW, AMD/OELp—4, London, UK, pp. 535-538 (Jan. 1, 2003).

*Primary Examiner* — Amare Mengistu
*Assistant Examiner* — Stacy Khoo
(74) *Attorney, Agent, or Firm* — Lee & Morse, P.C.

(57) ABSTRACT

An organic light emitting display includes a scan driver configured to sequentially supply a scan signal to scan lines and sequentially supply a light emitting control signal to light emitting control lines, a data driver configured to supply a data signal to data lines, and pixels arranged coupled to the scan lines, the data lines and the light emitting control lines. Each of the pixels includes an organic light emitting diode, a second transistor, a storage capacitor coupled between an i−1$^{th}$ light emitting control line and a gate electrode of the second transistor, a first transistor coupled between an i$^{th}$ scan line, a data line and a first electrode of the second transistor, and a third transistor coupled between the gate electrode and a second electrode of the second transistor.

20 Claims, 2 Drawing Sheets

FOREIGN PATENT DOCUMENTS

| | | | |
|---|---|---|---|
| EP | 1 764 771 | A | 3/2007 |
| JP | 2004-029791 | A | 1/2004 |
| JP | 2005-134874 | A | 5/2005 |
| JP | 2006-065328 | A | 3/2006 |
| JP | 2006-184846 | A | 7/2006 |
| JP | 2006-251455 | A | 9/2006 |
| JP | 2006-276253 | A | 10/2006 |
| JP | 2006-285210 | A | 10/2006 |
| JP | 2006-309119 | A | 11/2006 |
| KR | 10-2002-0054850 | A | 7/2002 |
| KR | 10-2003-0035195 | A | 5/2003 |
| KR | 10-2005-0068394 | A | 7/2005 |
| KR | 10-2005-0080318 | A | 8/2005 |
| KR | 10-2005-0098485 | A | 10/2005 |
| KR | 10-2005-0119367 | A | 12/2005 |
| KR | 10-2006-0028021 | A | 3/2006 |
| KR | 10-2006-0056792 | A | 5/2006 |

* cited by examiner

PIXEL, ORGANIC LIGHT EMITTING DISPLAY USING THE SAME, AND ASSOCIATED METHODS

BACKGROUND OF THE INVENTION

1. Field of the Invention

Embodiments relate to a pixel, an organic light emitting display using the same, and associated methods, which compensate for deterioration of a drive transistor.

2. Description of the Related Art

In the manufacture and operation of a display, e.g., a display used to reproduce text, images, video, etc., uniform operation of pixel elements of the display is highly desirable. However, providing such uniform operation may be difficult. For example, in some display technologies, e.g., those utilizing electroluminescent structures such as organic light emitting diodes (OLEDs), operational characteristics of the pixel elements may change over time. Accordingly, there is a need for a display adapted to compensate for changes in the operational characteristics of pixel elements.

SUMMARY OF THE INVENTION

Embodiments are therefore directed to a pixel, an organic light emitting display using the same, and associated methods, which substantially overcome one or more of the problems due to the limitations and disadvantages of the related art.

It is therefore a feature of an embodiment to provide a pixel, an organic light emitting display including the same, and associated methods, in which deterioration of a drive transistor is compensated.

It is therefore another feature of an embodiment to provide a pixel, an organic light emitting display including the same, and associated methods, in which an image having a desired grey level is displayed by increasing a voltage of a gate electrode of a drive transistor using a boosting capacitor.

At least one of the above and other features and advantages may be realized by providing an organic light emitting display, including a scan driver configured to sequentially supply a scan signal to scan lines and sequentially supply a light emitting control signal to light emitting control lines, a data driver configured to supply a data signal to data lines, and pixels arranged coupled to the scan lines, the data lines and the light emitting control lines. Each of the pixels may include an organic light emitting diode, a second transistor controlling an amount of electric current supplied to the organic light emitting diode, a storage capacitor coupled between an $i-1^{th}$ light emitting control line and a gate electrode of the second transistor, a first transistor coupled between an $i^{th}$ scan line, a data line and a first electrode of the second transistor, the first transistor being turned on when a scan signal is supplied to the $i^{th}$ scan line, and a third transistor coupled between the gate electrode and a second electrode of the second transistor, the third transistor being turned on when the scan signal is supplied to the $i^{th}$ scan line.

Each of the pixels may further include a boosting capacitor coupled between the gate electrode of the second transistor and the $i^{th}$ scan line. The storage capacitor may have a higher capacity than the boosting capacitor. Each of the pixels may further include a fourth transistor coupled between the second transistor and a first power source, the fourth transistor being turned on when the supply of a light emitting control signal to an $i^{th}$ light emitting control line is suspended, and a fifth transistor coupled between the second electrode of the second transistor and the organic light emitting diode, the fifth transistor being turned on when the supply of the light emitting control signal to the $i^{th}$ light emitting control line is suspended.

The first and third transistors may be turned on when a scan signal is supplied to the $i^{th}$ scan line, and the fourth and fifth transistors are turned off when the light emitting control signal is supplied to the $i^{th}$ light emitting control line. The first, second, third, fourth, and fifth transistors may be PMOS transistors. The scan driver may supply the light emitting control signal to the $i^{th}$ light emitting control line such that it overlaps with the scan signals supplied to an $i-1^{th}$ scan line and the $i^{th}$ scan line. The first and fourth transistors may not be on at the same time, and the first and fifth transistors may not be on at the same time.

The light emitting control signal may have a base voltage and a positive pulse voltage, the scan signal may have a base voltage and a negative pulse voltage, and the positive pulse voltage of the light emitting control signal may be greater than the base voltage of the scan signal. Pixels in an $i^{th}$ row may be coupled to an $i^{th}$ light emitting control line and the $i-1^{th}$ light emitting control line, and pixels in an $i-1^{th}$ row may be coupled to the $i-1^{th}$ light emitting control line and an $i-2^{th}$ light emitting control line.

At least one of the above and other features and advantages may also be realized by providing a pixel, including an organic light emitting diode, a second transistor controlling an amount of electric current supplied to the organic light emitting diode, a storage capacitor coupled between an $i-1^{th}$ light emitting control line and a gate electrode of the second transistor, a first transistor coupled between an $i^{th}$ scan line, a data line and a first electrode of the second transistor, the first transistor being turned on when a scan signal is supplied to the $i^{th}$ scan line, and a third transistor coupled between the gate electrode and a second electrode of the second transistor, the third transistor being turned on when the scan signal is supplied to the $i^{th}$ scan line.

Each of the pixels may further include a boosting capacitor coupled between the gate electrode of the second transistor and the $i^{th}$ scan line. The storage capacitor may have a higher capacity than the boosting capacitor. Each of the pixels may further include a fourth transistor coupled between the second transistor and a first power source, the fourth transistor being turned on when the supply of a light emitting control signal to an $i^{th}$ light emitting control line is suspended, and a fifth transistor coupled between the second electrode of the second transistor and the organic light emitting diode, the fifth transistor being turned on when the supply of the light emitting control signal to the $i^{th}$ light emitting control line is suspended. The first, second, third, fourth, and fifth transistors may be PMOS transistors.

At least one of the above and other features and advantages may be realized by providing a method for driving an organic light emitting display including pixels having a storage capacitor coupled between a gate electrode of a drive transistor and an $i-1^{th}$ light emitting control line, the method including supplying a light emitting control signal to the $i-1^{th}$ light emitting control line to increase a voltage of the gate electrode of the drive transistor, suspending the supply of the light emitting control signal to the $i-1^{th}$ light emitting control line and simultaneously supplying a scan signal to an $i^{th}$ scan line to charge a voltage corresponding to a data signal and a threshold voltage of the drive transistor in the storage capacitor, and supplying an electric current corresponding to the voltage charged in the storage capacitor to an organic light emitting diode.

The method may further include employing a boosting capacitor coupled between the $i^{th}$ scan line and the gate electrode of the drive transistor to increase the voltage of the gate electrode of the drive transistor when the supply of the scan signal to the $i^{th}$ scan line is suspended. The storage capacitor may have a higher capacity than the boosting capacitor. When the light emitting control signal is supplied to the $i-1^{th}$ light emitting control line, the $i-1^{th}$ light emitting control line may be supplied with a higher voltage than a voltage supplied to the $i^{th}$ scan line when the supply of a scan signal to the $i^{th}$ scan line is suspended.

BRIEF DESCRIPTION OF THE DRAWINGS

The above and other features and advantages will become more apparent to those of ordinary skill in the art by describing in detail example embodiments with reference to the attached drawings, in which.

DETAILED DESCRIPTION OF THE INVENTION

Figure 1:
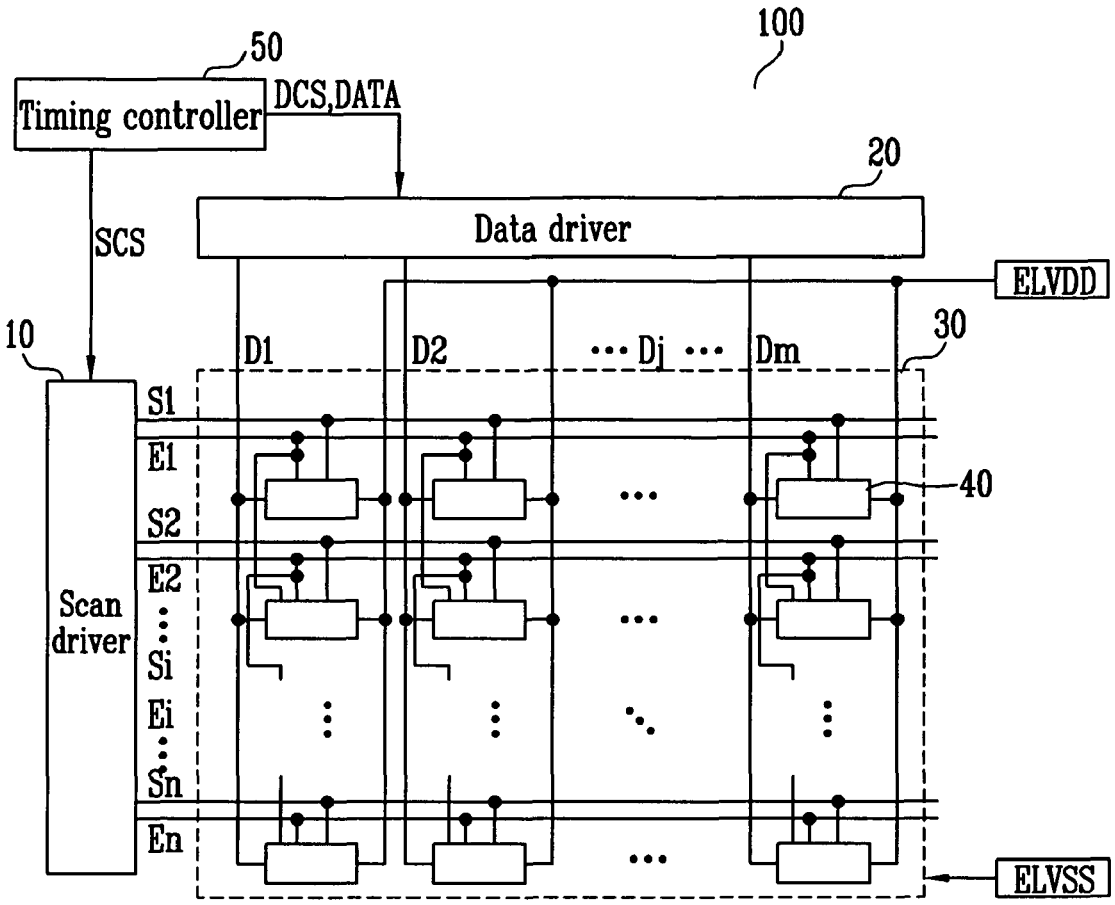
FIG. 1 illustrates a schematic diagram of an organic light emitting display according to an embodiment.

Korean Patent Application No. 10-2007-0035008, filed on Apr. 10, 2007, in the Korean Intellectual Property Office, and entitled: "Organic Light Emitting Display and Driving Method of Organic Light Emitting Display" is incorporated by reference herein in its entirety.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the invention to those skilled in the art.

In the drawing figures, the dimensions of layers and regions may be exaggerated, or elements may be omitted, for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present.

Similarly, where an element is described as being coupled to a second element, the element may be directly coupled to the second element, or may be indirectly coupled to the second element via one or more other elements. Further, where an element is described as being coupled to a second element, it will be understood that the elements may be electrically coupled, e.g., in the case of transistors, capacitors, power sources, nodes, etc. Where two or more elements are described as being coupled to a node, the elements may be directly coupled to the node, or may be coupled via conductive features to which the node is common. Thus, where embodiments are described or illustrated as having two or more elements that are coupled at a common point, it will be appreciated that the elements may be coupled at respective points on a conductive feature that extends between the respective points. Like reference numerals refer to like elements throughout.

As used herein, in the context of PMOS transistors, when a scan signal is described as being supplied, the scan signal has a LOW polarity, and when the scan signal is described as being stopped, the scan signal has a HIGH polarity. Further, when a light emitting control signal is described as being supplied, the light emitting control signal has a HIGH polarity, and when the light emitting control signal is described as being stopped, the light emitting control signal has a LOW polarity. When signals are described as overlapping, the signals are concurrently supplied.

An organic light emitting display according to embodiments may generate light using an organic light emitting diode, which may emit light corresponding to an amount of electric current supplied from a drive transistor. The drive transistor may deteriorate over time, however. Accordingly, an organic light emitting display according to embodiments may compensate for deterioration of a drive transistor by increasing a voltage of the gate electrode of the drive transistor during a portion of one frame. In particular, the organic light emitting display may compensate for deteriorated characteristics of the drive transistor by applying a high voltage to the gate electrode of the drive transistor during a portion of one frame.

An organic light emitting display according to embodiments may also display an image having a desired grey level by increasing a voltage of a node that is coupled to a gate electrode of the drive transistor using a boosting capacitor. In contrast, a conventional display may not display an image with a desired grey level, e.g., a black grey level, when the data signal is charged in a parasitic capacitor present in the data line, and is then supplied to a storage capacitor. Thus, in the conventional organic light emitting display, a voltage that is lower than a desired voltage may be stored in the storage capacitor due to charge sharing between the parasitic capacitor in the data line and the storage capacitor. This may prevent the conventional organic light emitting display from displaying an image having a desired grey level.

FIG. 1 illustrates a schematic diagram of an organic light emitting display 100 according to an embodiment. Referring to FIG. 1, the organic light emitting display 100 may include a pixel unit 30 including pixels 40 formed at crossing points of scan lines S1 to Sn, data lines D1 to Dm, and light emitting control lines E1 to En. The display 100 may further include a scan driver 10 for driving the scan lines S1 to Sn and the light emitting control lines E1 to En, a data driver 20 for driving the data lines D1 to Dm, and a timing controller 50 for controlling the scan driver 10 and the data driver 20.

The scan driver 10 may generate a scan signal in response to a scan drive control signal SCS supplied from the timing controller 50, and may sequentially supply the generated scan signal to the scan lines S1 to Sn. The scan driver 10 may generate a HIGH light emitting control signal in response to the scan drive control signals SCS, and may sequentially supply the generated HIGH light emitting control signal to the light emitting control lines E1 to En.

Figure 2:
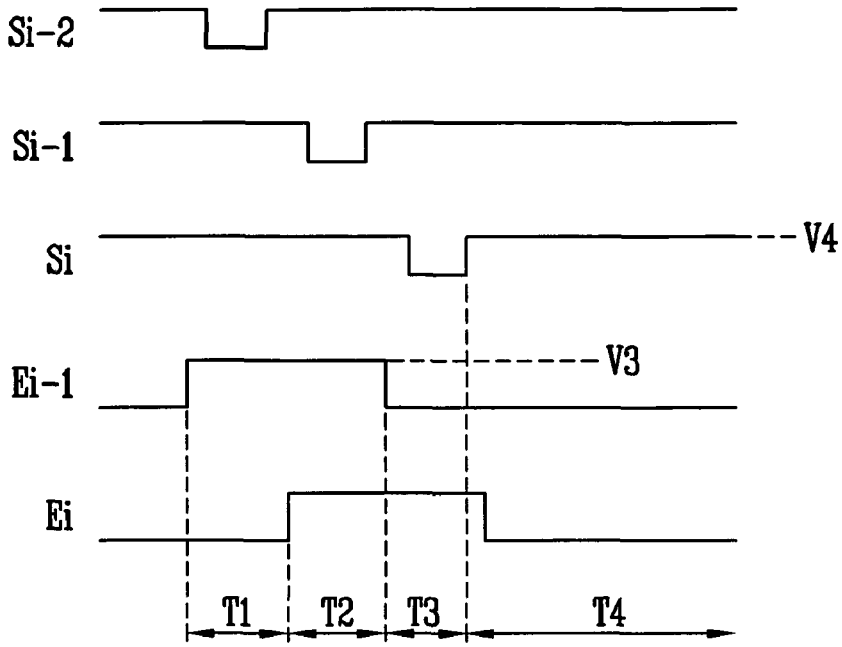
FIG. 2 illustrates signal waveforms for scan and light emitting control signals supplied from a scan driver shown in FIG. 1.

The scan driver 10 may sequentially supply a HIGH light emitting control signal to an $i-1^{th}$ light emitting control line Ei−1 (i is a natural number from 1 to n, inclusive) and an $i^{th}$ light emitting control line Ei, and may sequentially supply a LOW scan signal to an $i-1^{th}$ scan line Si−1 and an $i^{th}$ scan line Si. The light emitting control signal may overlap the scan signal, such that the light emitting control signal is HIGH while the scan signal is LOW, as shown in FIG. 2.

The data driver 20 may generate data signals in response to a data drive control signal DCS supplied from the timing controller 50, and may supply the generated data signals to the data lines D1 to Dm. During each horizontal period 1H, the data driver 20 may supply a data signal of one line to the data lines D1 to Dm.

The timing controller 50 may generate the data drive control signal DCS and the scan drive control signal SCS in correspondence with externally-supplied synchronizing signals. The data drive control signal DCS generated in the timing controller 50 may be supplied to the data driver 20, and the scan drive control signal SCS may be supplied to the scan driver 10. The timing controller 50 may rearrange data DATA supplied from an external source, and may supply the rearranged data DATA to the data driver 20.

The pixel unit 30 may receive power from a first power source ELVDD and a second power source ELVSS. The first and second power sources ELVDD and ELVSS may be external to the pixel unit 30. The pixel unit 30 may supply the power from the first and second power sources ELVDD and ELVSS to each of the pixels 40.

The pixels 40 may receive power from the first and second power sources ELVDD and ELVSS, and may control an amount of electric current flowing therebetween in correspondence with the data signal. The electric current controlled by the pixels 40 may flow from the first power source ELVDD to the second power source ELVSS via respective organic light emitting diodes OLEDs in the pixels 40. A light emission time of the pixels 40 may be controlled by the light emitting control signal.

For an $i^{th}$ horizontal line, pixels 40 arranged in the $i^{th}$ horizontal line may be coupled to the $i^{th}$ scan line Si, the $i-1^{th}$ light emitting control line Ei−1, and the $i^{th}$ light emitting control line Ei. In an implementation (not shown), pixels 40 arranged in the first horizontal line may be coupled to a $0^{th}$ light emitting control line E0.

Figure 3:
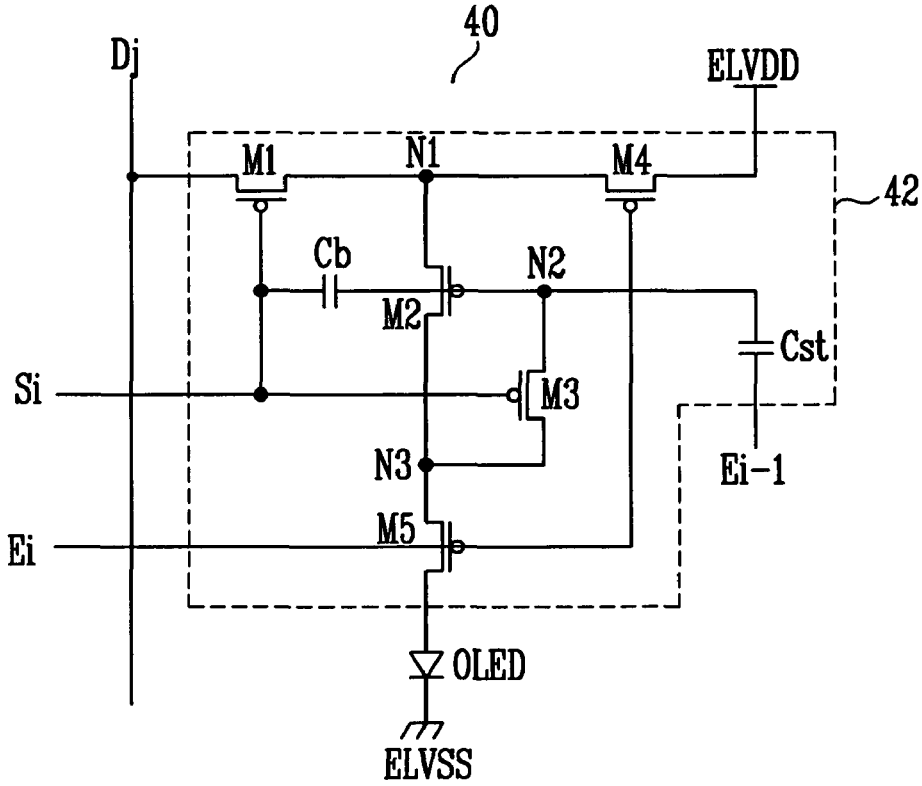
FIG. 3 illustrates a schematic circuit diagram of a pixel according to an embodiment.

FIG. 3 illustrates a schematic circuit diagram of a pixel 40 according to an embodiment. In FIG. 3, an example pixel 40 is coupled to the $i^{th}$ scan line Si, a $j^{th}$ data line Dj (j is a natural number from 1 to m, inclusive), the $i-1^{th}$ light emitting control line Ei−1, and the $i^{th}$ light emitting control line Ei.

Referring to FIG. 3, the pixel 40 may include an organic light emitting diode OLED and a pixel circuit 42 for controlling an amount of electric current supplied to the organic light emitting diode OLED. The pixel circuit 42 may control the amount of electric current supplied to the organic light emitting diode OLED in correspondence with the data signal supplied to the data line Dj when a scan signal is supplied to the scan line Si. The organic light emitting diode OLED may generate light having a predetermined luminance in correspondence with the electric current supplied from the pixel circuit 42. The organic light emitting diode OLED may generate a color, e.g., one of red, green, or blue.

An anode electrode of the organic light emitting diode OLED may be coupled to the pixel circuit 42, and a cathode electrode of the organic light emitting diode OLED may be coupled to the second power source ELVSS. The second power source ELVSS may be set to a lower voltage than that of the first power source ELVDD.

The pixel circuit 42 may include first to fifth transistors M1 to M5, a storage capacitor Cst, and a boosting capacitor Cb. A first electrode of the first transistor M1 may be coupled to the data line Dj, and a second electrode of the first transistor M1 may be coupled to a first electrode of the second transistor M2 via a first node N1. A gate electrode of the first transistor M1 may be coupled to the scan line Si. The first transistor M1 may be turned on when a LOW scan signal is supplied to the scan line Si. The first transistor M1 may provide the data signal from the data line Dj to the first electrode of the second transistor M2 via the first node N1.

The first electrode of the second transistor M2 may be coupled to the second electrode of the first transistor M1 via the first node N1, and a second electrode of the second transistor M2 may be coupled to a first electrode of the fifth transistor M5 via a third node N3. A gate electrode of the second transistor M2 may be coupled to a second node N2. The second transistor M2 may supply an electric current to the organic light emitting diode OLED, the electric current corresponding to a voltage applied to the second node N2.

A first electrode of the third transistor M3 may be coupled to the second electrode of the second transistor M2 via the third node N3, and a second electrode of the third transistor M3 may be coupled to the second node N2. Thus, the third transistor M3 may be configured to diode-connect the second transistor M2. A gate electrode of the third transistor M3 may be coupled to the scan line Si. The third transistor M3 may be turned on when a LOW scan signal is supplied to the scan line Si.

A first electrode of the fourth transistor M4 may be coupled to the first power source ELVDD. A second electrode of the fourth transistor M4 may be coupled to the first node N1, such that the second electrode of the fourth transistor M4 is coupled to the first electrode of the second transistor M2 as well as the second electrode of the first transistor M1. A gate electrode of the fourth transistor M4 may be coupled to the $i^{th}$ light emitting control line Ei. The fourth transistor M4 may be turned on when a HIGH light emitting control signal is not supplied, i.e., it may be turned on by a LOW signal. The fourth transistor M4 may couple the first electrode of the second transistor M2 to the first power source ELVDD via the first node N1.

The first electrode of the fifth transistor M5 may be coupled to the second electrode of the second transistor M2 via the third node N3, and a second electrode of the fifth transistor M5 may be coupled to the anode electrode of the organic light emitting diode OLED. A gate electrode of fifth transistor M5 may be coupled to the $i^{th}$ light emitting control line Ei. The fifth transistor M5 may be turned on when a HIGH light emitting control signal is not supplied, i.e., it may be turned on by a LOW signal. The fifth transistor M5 may couple the organic light emitting diode OLED to the second electrode of the second transistor M2 via the third node N3.

The storage capacitor Cst may be coupled between the second node N2 and the $i-1^{th}$ light emitting control line Ei−1. The storage capacitor Cst may charge a voltage corresponding to the data signal. The storage capacitor Cst may transmit an amount of changed voltage of the $i-1^{th}$ light emitting control line Ei−1 to the second node N2, as described in more detail below.

The boosting capacitor Cb may be coupled between the scan line Si and the second node N2. The boosting capacitor Cb may increase a voltage of the second node N2 when the supply of the scan signal to the scan line Si stops, i.e., when the scan signal goes HIGH.

Operation of the organic light emitting display will now be described in more detail with reference to FIGS. 2 and 3. Referring to FIGS. 2 and 3, a HIGH light emitting control signal may be supplied to the $i-1^{th}$ light emitting control line Ei−1 at the start of a first period T1, such that a voltage of the second node N2 set to a floating state is increased.

As the voltage of the second node N2 is increased, a voltage of the gate electrode of the second transistor M2 may increase. Therefore, deteriorated characteristics of the second transistor M2 may be improved. For example, deterioration of the second transistor M2 may be compensated if a reverse bias voltage is applied to the second transistor M2 during a period of one frame, e.g., a period when the light emitting control signal is supplied to the $i-1^{th}$ light emitting control line Ei−1.

Referring to FIG. 2, the scan signal may have a fourth voltage V4, and the light emitting control signal may have a third voltage V3. The third voltage V3 may be set to a higher voltage than the fourth voltage V4. For example, the third voltage V3 may have a value that is higher than the sum of the fourth voltage V4 and the threshold voltage of the third transistor M3. Thus, the third transistor M3 may be turned on when a HIGH light emitting control signal is supplied to the $i-1^{th}$ light emitting control line En−1.

During the first period T1, a reverse bias voltage of the second transistor M2 may be applied, and the third transistor M3 may be turned on simultaneously. When the third transistor M3 is turned on, a voltage applied to the second node N2 during a prior period may be reset via the third transistor M3, the fifth transistor M5, and the organic light emitting diode OLED.

At the start of a second period T2, a HIGH light emitting control signal may be supplied to the $i^{th}$ light emitting control line Ei, such that the fourth transistor M4 and the fifth transistor M5 are turned off.

At the start of a third period T3, the supply of the HIGH light emitting control signal to the $i-1^{th}$ light emitting control line Ei−1 may stop. During the third period T3, the scan signal may be supplied to the scan line Si. When the scan signal is supplied to the scan line Si, the first transistor M1 and the third transistor M3 may be turned on. When the first transistor M1 is turned on, a data signal may be supplied from the data line Dj to the first electrode of the second transistor M2 via the first transistor M1. At this time, the second transistor M2 may be turned on, since the voltage of the second node N2 may be reset during the first period T1. When the second transistor M2 is turned on, the data signal may be supplied to the second node N2 via the second transistor M2 and the third transistor M3. At this time, the storage capacitor Cst may charge a voltage corresponding to the data signal and the threshold voltage of the second transistor M2. The voltage value of the data signal may be determined experimentally and set to stably control a channel width of the second transistor M2.

At the end of the third period T3, the supply of a LOW scan signal to the scan line Si may stop. When the supply of the light emitting control signal to the $i-1^{th}$ light emitting control line Ei−1 stops, a voltage of the second node N2 may decrease.

During a fourth period T4, the LOW scan signal may not be supplied to the scan line Si, and the supply of the HIGH light emitting control signal to the $i^{th}$ light emitting control line Ei may stop. When the supply of the LOW scan signal to the scan line Si stops, a voltage of the scan line Si may increase from the LOW voltage to the fourth voltage V4. The voltage of the second node N2 may also be increased to a predetermined voltage by the boosting capacitor Cb, in correspondence with an amount of increased voltage of the scan line Si, as described in detail below. When the voltage of the second node N2 is increased, an image may be displayed with a desired grey level. In particular, an image having a desired grey level may be displayed by increasing a voltage of the second node N2 as much as a voltage lost from charge sharing of a parasitic capacitor and a storage capacitor Cst of the data line Dj.

The amount of increased voltage of the second node N2 may be determined according to the amount of the increased voltage of the scan line Si, and according to the capacities of the boosting capacitor Cb and the storage capacitor Cst. The capacity of the storage capacitor Cst may be set to be higher than that of the boosting capacitor Cb. Accordingly, the voltage of the second node N2 may be increased as much as the voltage of the data signal that is lost to charge sharing.

When the supply of the HIGH light emitting control signal to the $i^{th}$ light emitting control line Ei stops during the fourth period T4, the fourth transistor M4 and the fifth transistor M5 may be turned on. At this time, the second transistor M2 may supply an electric current from the first power source ELVDD to the organic light emitting diode OLED via the fourth transistor M4 and the fifth transistor M5, where the amount of the electric current corresponds to the voltage applied to the second node N2. Thus, light having a predetermined luminance may be generated by the organic light emitting diode OLED.

Exemplary embodiments have been disclosed herein, and although specific terms are employed, they are used and are to be interpreted in a generic and descriptive sense only and not for purpose of limitation. For example, the first to fifth transistors M1 to M5 are shown as PMOS type transistors in FIG. 3, but it will be understood that the first to fifth transistors M1 to M5 may be implemented as NMOS type transistors, in which this case they may be driven with waveforms having a reversed polarity. Accordingly, it will be understood by those of ordinary skill in the art that various changes in form and details may be made without departing from the spirit and scope of the present invention as set forth in the following claims.

What is claimed is:

1. An organic light emitting display, comprising:

a scan driver configured to sequentially supply a scan signal to scan lines and sequentially supply a light emitting control signal to light emitting control lines;

a data driver configured to supply a data signal to data lines; and pixels arranged coupled to the scan lines, the data lines and the light emitting control lines, wherein:

each of the pixels includes:

an organic light emitting diode, a second transistor controlling an amount of electric current supplied to the organic light emitting diode, a storage capacitor coupled between an $i-1^{th}$ light emitting control line and a gate electrode of the second transistor, a first transistor coupled between an $i^{th}$ scan line, a data line and a first electrode of the second transistor, the first transistor being turned on when a scan signal is supplied to the $i^{th}$ scan line, a third transistor coupled between the gate electrode and a second electrode of the second transistor, the third transistor being turned on when the scan signal is supplied to the $i^{th}$ scan line, and a boosting capacitor coupled between the gate electrode of the second transistor and the $i^{th}$ scan line, the light emitting control signal has a base voltage and a positive pulse voltage, the scan signal has a base voltage and a negative pulse voltage, and the positive pulse voltage of the light emitting control signal is greater than the base voltage of the scan signal.

2. The display as claimed in claim 1, wherein the storage capacitor has a higher capacity than the boosting capacitor.

3. The display as claimed in claim 1, wherein:

pixels in an $i^{th}$ row are coupled to an $i^{th}$ light emitting control line and the $i-1^{th}$ light emitting control line, and pixels in an $i-1^{th}$ row are coupled to the $i-1^{th}$ light emitting control line and an $i-2^{th}$ light emitting control line.

4. The display as claimed in claim 1, wherein the second electrode of the second transistor is coupled to the organic light emitting diode, such that the second electrode of the second transistor is between the second transistor and the organic light emitting diode.

5. The display as claimed in claim 4, wherein each of the pixels further includes:

a fourth transistor, the fourth transistor having a first electrode coupled to a first power source and having a second electrode coupled to the first electrode of the second transistor, such that the fourth transistor is between the second transistor and the first power source, the fourth transistor being turned on when the supply of a light emitting control signal to an $i^{th}$ light emitting control line is suspended, and a fifth transistor coupled between the second electrode of the second transistor and the organic light emitting diode, the fifth transistor being turned on when the supply of the light emitting control signal to the $i^{th}$ light emitting control line is suspended.

6. The display as claimed in claim 5, wherein:

the first and third transistors are turned on when a scan signal is supplied to the $i^{th}$ scan line, and the fourth and fifth transistors are turned off when the light emitting control signal is supplied to the $i_{th}$ light emitting control line.

7. The display as claimed in claim 6, wherein the first, second, third, fourth, and fifth transistors are PMOS transistors.

8. The display as claimed in claim 6, wherein the scan driver supplies the light emitting control signal to the $i^{th}$ light emitting control line such that it overlaps with the scan signals supplied to an $i-1^{th}$ scan line and the $i^{th}$ scan line.

9. The display as claimed in claim 8, wherein:

the first and fourth transistors are not on at the same time, and the first and fifth transistors are not on at the same time.

10. The display as claimed in claim 4, wherein a second electrode of the first transistor is coupled to the first electrode of the second transistor, such that, when the first transistor is turned on when the scan signal is supplied to the $i^{th}$ scan line, the first transistor supplies a data signal from the data line to the first electrode of the second transistor.

11. A pixel, comprising:

an organic light emitting diode;

a second transistor controlling an amount of electric current supplied to the organic light emitting diode;

a storage capacitor coupled between an $i-1^{th}$ light emitting control line and a gate electrode of the second transistor, a light emitting control signal being supplied to the $i-1^{th}$ light emitting control line;

a first transistor coupled between an $i^{th}$ scan line, a data line and a first electrode of the second transistor, the first transistor being turned on when a scan signal is supplied to the $i^{th}$ scan line;

a third transistor coupled between the gate electrode and a second electrode of the second transistor, the third transistor being turned on when the scan signal is supplied to the $i^{th}$ scan line; and a boosting capacitor coupled between the gate electrode of the second transistor and the $i^{th}$ scan line, wherein:

the light emitting control signal has a base voltage and a positive pulse voltage, the scan signal has a base voltage and a negative pulse voltage, and the positive pulse voltage of the light emitting control signal is greater than the base voltage of the scan signal.

12. The pixel as claimed in claim 11, wherein the storage capacitor has a higher capacity than the boosting capacitor.

13. The pixel as claimed in claim 11, wherein the second electrode of the second transistor is coupled to the organic light emitting diode, such that the second electrode of the second transistor is between the second transistor and the organic light emitting diode.

14. The pixel as claimed in claim 13, wherein the pixel further includes:

a fourth transistor, the fourth transistor having a first electrode coupled to a first power source and having a second electrode coupled to the first electrode of the second transistor, such that the fourth transistor is between the second transistor and the first power source, the fourth transistor being turned on when the supply of a light emitting control signal to an $i^{th}$ light emitting control line is suspended, and a fifth transistor coupled between the second electrode of the second transistor and the organic light emitting diode, the fifth transistor being turned on when the supply of the light emitting control signal to the $i^{th}$ light emitting control line is suspended.

15. The display as claimed in claim 14, wherein the first, second, third, fourth, and fifth transistors are PMOS transistors.

16. The pixel as claimed in claim 13, wherein a second electrode of the first transistor is coupled to the first electrode of the second transistor, such that, when the first transistor is turned on when the scan signal is supplied to the $i^{th}$ scan line, the first transistor supplies a data signal from the data line to the first electrode of the second transistor.

17. A method for driving an organic light emitting display including pixels having a storage capacitor, a first electrode of the storage capacitor being coupled to a gate electrode of a drive transistor, and a second electrode of the storage capacitor being coupled to an $i-1^{th}$ light emitting control line, the method comprising:

supplying a light emitting control signal to the $i-1^{th}$ light emitting control line to increase a voltage of the gate electrode of the drive transistor via the storage capacitor;

suspending the supply of the light emitting control signal to the $i-1^{th}$ light emitting control line and simultaneously supplying a scan signal to an $i^{th}$ scan line to charge a voltage corresponding to a data signal and a threshold voltage of the drive transistor in the storage capacitor; and supplying an electric current corresponding to the voltage charged in the storage capacitor to an organic light emitting diode.

18. The method as claimed in claim 17, further comprising employing a boosting capacitor coupled between the $i^{th}$ scan line and the gate electrode of the drive transistor to increase the voltage of the gate electrode of the drive transistor when the supply of the scan signal to the $i^{th}$ scan line is suspended.

19. The method as claimed in claim 18, wherein the storage capacitor has a higher capacity than the boosting capacitor.

20. The method as claimed in claim 17, wherein, when the light emitting control signal is supplied to the $i-1^{th}$ light emitting control line, the $i-1^{th}$ light emitting control line is supplied with a higher voltage than a voltage supplied to the $i^{th}$ scan line when the supply of a scan signal to the $i^{th}$ scan line is suspended.

* * * * *